US006789274B1

(12) United States Patent
Karpati

(10) Patent No.: US 6,789,274 B1
(45) Date of Patent: Sep. 14, 2004

(54) ENHANCED CHEST PROTECTOR

(76) Inventor: Thomas Karpati, 7 Gary St., Lindenhurst, NY (US) 11757

( * ) Notice: Subject to any disclaimer, the term of this patent is extended or adjusted under 35 U.S.C. 154(b) by 0 days.

(21) Appl. No.: 10/641,660

(22) Filed: Aug. 15, 2003

(51) Int. Cl.[7] ..... A41D 13/00

(52) U.S. Cl. ..... 2/463; 2/458; 62/259.3; 607/108

(58) Field of Search ..... 2/461, 462, 463, 2/464, 465, 466, 467, 458; 62/259.3; 607/108, 112

(56) References Cited

U.S. PATENT DOCUMENTS

| | | | | | |
|---|---|---|---|---|---|
| 1,657,866 | A | * | 1/1928 | Mooney | 2/462 |
| 4,525,875 | A | | 7/1985 | Tomczak | 2/2 |
| 4,870,706 | A | * | 10/1989 | Ketcham et al. | 2/461 |
| 4,993,076 | A | | 2/1991 | Dierickx | 2/2 |
| 5,072,455 | A | * | 12/1991 | St. Ours | 2/81 |
| 5,305,471 | A | * | 4/1994 | Steele et al. | 2/102 |
| 5,383,920 | A | * | 1/1995 | Sikes | 607/112 |
| 5,415,222 | A | * | 5/1995 | Colvin et al. | 165/46 |
| 5,524,293 | A | * | 6/1996 | Kung | 2/102 |
| 5,551,082 | A | | 9/1996 | Stewart et al. | 2/2 |
| 5,623,729 | A | | 4/1997 | Chen | 2/431 |
| 5,692,238 | A | * | 12/1997 | Watson, Jr. | 2/102 |
| 5,937,447 | A | | 8/1999 | Howell | 2/463 |
| 5,950,249 | A | | 9/1999 | Clement | 2/463 |
| 6,035,452 | A | | 3/2000 | Braxton | 2/455 |
| 6,048,327 | A | | 4/2000 | Kieffer | 462/70 |
| 6,145,134 | A | * | 11/2000 | Davis et al. | 2/463 |
| 6,351,854 | B1 | | 3/2002 | Whalen et al. | 2/413 |
| 6,397,399 | B1 | * | 6/2002 | Lampe et al. | 2/425 |
| 6,485,446 | B1 | * | 11/2002 | Brother et al. | 602/20 |
| 6,493,881 | B1 | * | 12/2002 | Picotte | 2/413 |
| 6,519,782 | B2 | | 2/2003 | Collins et al. | 2/463 |
| 2002/0016984 | A1 | * | 2/2002 | Poholski | 2/94 |
| 2003/0046752 | A1 | * | 3/2003 | Baumann | 2/463 |

* cited by examiner

*Primary Examiner*—Rodney M. Lindsey

(57) ABSTRACT

An enhanced chest protector for usage in sporting events and hazardous activities. More particularly, the invention is a chest protector that utilizes a soft, pliable gel attached to the previously-existing chest protector to greatly enhance absorption and dissipation of impact forces. The gel is of a type commonly used for heat or freezer packs, and is configured in many separate panels to keep the gel from flowing across the entire device. Importantly, the gel is durable and lightweight, which allows the player to wear the product comfortably for extended periods of time. In addition, the gel may be frozen or refrigerated prior to use, so as to provide cooling for the player in hot water. In total, usage of the present invention allows the user to be well-protected when struck in the chest area with potentially damaging items, such as balls or pucks used in sporting event

11 Claims, 2 Drawing Sheets

ENHANCED CHEST PROTECTOR

BACKGROUND OF THE INVENTION

1. Field of the Invention

The present invention is an enhanced chest protector for usage in sporting events and hazardous activities. More particularly, the invention is a chest protector that utilizes a soft, pliable gel attached to the previously-existing chest protector to greatly enhance absorption and dissipation of impact forces.

The gel is of a type commonly used for heat or freezer packs, and is configured in many separate panels to keep the gel from flowing across the entire device. Importantly, the gel is durable and lightweight, which allows the player to wear the product comfortably for extended periods of time. In addition, the gel may be frozen or refrigerated prior to use, so as to provide cooling for the player in hot weather. In total, usage of the present invention allows the user to be well-protected when struck in the chest area with potentially damaging items, such as balls or pucks used in sporting events.

2. Description of the Prior Art

Numerous innovations for chest protectors and protection devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 6,519,782, invented by Collins et al., entitled "Baseball Catcher's Chest Protector"

The patent to Collins et al. describes a chest protector that includes a pouch assembly having an interior in communication with an opening, the pouch assembly having a hole in fluid communication with the interior and ambient air and a pad inserted into the interior, wherein the pad includes an opening that is in fluid communication with the hole of the pouch assembly.

2. U.S. Pat. No. 4,525,875, invented by Tomczak, entitled "Chest Protector With Rigid Plates"

The patent to Tomczak describes an improved chest protector including additional protection to the sternum area of an athlete's chest. The additional protection is provided by relatively rigid plates bonded to the conventional shock-absorbing chest protector material on the side opposite the wearer's body and directly over the sternum area. The plates distribute the impact from a high speed object over a relatively large area of the shock-absorbing material, thus allowing the chest protector to absorb more of the object's energy than is possible with prior chest protectors.

3. U.S. Pat. No. 4,993,076, invented by Dierickx, entitled "Chest Protector"

The patent to Dierickx describes a light-weight, shock-absorbing chest protector worn, for example, by participants in sports, the protector allowing air circulation to a wearer's body while providing enhanced flexibility. The protector conforms to a wearer's body and flexes inwardly and outwardly and expands and contracts vertically with the wearer's movements. The protector, which is coated with a durable coating to add color as well as additional strength to the protector, is attached to a wearer's body through the use of a harness. Apertures through the protector are shaped to "grab"a ball which strikes the protector and drop the ball near to the wearer, while also reducing the weight of the protector, providing air circulation through the protector, and giving the protector the enhanced flexibility. The protector has optional hinged pads for covering additional areas of a wearer's body without inhibiting freedom of movement.

4. U.S. Pat. No. 5,623,729, invented by Chen, entitled "Chest Protector"

The chest protector of the Chen invention consists of an upper guard portion and a lower padding portion, the upper guard portion comprising a right and a left shoulder guard panels, a chest guard panel and a plurality of abdomen guard panels, each being injection molded from engineering plastic and provided with a plurality of holes, so that respective guard panels are connected with one another by means of a plurality of connecting plates and the buttons provided on the connecting plates. When the upper guard portion is assembled into a proper shape and size, the lower padding portion with corresponding shape and size can be selected with the upper guard portion being laid on the lower padding portion, and then having rivets driven into those holes on the guard panels not occupied by the buttons of the connecting plates, so that the upper guard portion is secured to the lower padding portion.

5. U.S. Pat. No. 5,937,447, invented by Howell, entitled "Protective Garment"

In the patent to Howell, a protective garment is provided including a chest protector being formed of solid foam. Also included is an abdominal protector including a plurality of inflatable tubular mechanisms. The abdominal protector is connected to the chest protector. Next provided is a groin protector connected to the abdominal protector and formed of solid foam. Finally, a strap assembly is provided for securing the protectors on a user.

6. U.S. Pat. No. 5,950,249, invented by Clement, entitled "Stealth Chest Guard"

In the patent to Clement, The Stealth Chest Guard's size is 5"⅝" by 11"⅜" by 3/8" thick, and it is comprised of a rubber pad to absorb the hit from an object such as a ball coming off of a bat or a bounce coming from the ground directed to the heart area. The plastic caplike shape that goes over the rubber is to help distribute the impact away from the heart area and give more support to the rubber pad. the soft terry cloth is worn for comfort and to let the skin breath. The flexibility of the rubber pad and the size of this chest guard was a very important factor. The players in the field need protection, but they need flexibility, and protection without the bulk that comes with other protective gear. The Stealth Chest Guard is light weight, comfortable, durable, and provides a protection for the players that is not yet available to them.

7. U.S. Pat. No. 6,035,452, invented by Braxton, entitled "Expansible Protective Body Pouches Employing Removable-Replaceable Components"

In the patent to Braxton, expansible sport protective body pouches for torso and extremities are disclosed that dissipate impact energy away from the body by expanding and compressing at predesigned rates when subjected to the forces of impact trauma. Comprised of anatomically-shaped two layer expansible protective pouches, and removable replaceable internal impact deceleration control components, the design allows individual deceleration control elements; foam impact dispersant replaceable inserts with impact deceleration-body heat venting apertures, and replaceable penetration resistant impact trauma shields with impact deceleration control-body heat venting apertures, to be inserted or removed from the replaceable expansible protective pouch. The expansible protective pouch is constructed of various cloth material combinations selected by the wearer; internal impact deceleration control element materials are also a plurality wearer option. The expansible protective pouch and it's ancillary internal components can be completely disassembled in the field to facilitate replacement, upgrades, or exchanging of elements, including the protective pouch, so as to alter individual protective pouch performance characteristics.

8. U.S. Pat. No. 6,048,327, invented by Kieffer, entitled "Athletic Supporter With Gel Material"

The patent to Kieffer describes a cushioning pad, sized to be disposed about the inguinal area of a human male and to be worn for the support and protection of said area, contains a gel material to protect against both localized blows and chafing. The pad fits into a protective garment having a securing means for securing it about the inguinal area. In one embodiment, the pad further comprises an inner layer of gel material, an outer layer of gel material, and a layer of shaping material disposed therebetween. The layer of shaping material may be sized to be shorter and narrower than the inner layer and outer layer of gel material so that the layer of shaping material is completely interior to the cushioning pad, and no sharp or blunt plastic edges can come into contact with the body of the athlete. In a further aspect of the invention, a protective garment to be worn for the support and protection of the inguinal area comprises a waist band, a pouch disposed about the inguinal area when the garment is worn, and, disposed within the pouch, a cushioning pad containing a gel material. Methods for forming a cushioning pad are also disclosed. One method comprises pouring into a mold an inner layer of gel material; fitting, above the inner layer, a layer of shaping material having an outer edge; and pouring an outer layer of gel material. Another method discloses pouring into a mold the inner layer of gel material. When the gel material is partially set, a layer of shaping material is fitted and pressed into the inner layer so that the gel material oozes up and over the outer edge of the layer of shaping material to form an outer layer of gel material. In yet another embodiment, the pad is formed by forming a first and second sheets of gel; and attaching the layer of shaping material therebetween.

9. U.S. Pat. No. 6,351,854, invented by Whalen et al., entitled "Personal Protection Device"

The patent to Whalen et al. describes a load absorbing apparatus for use in protective equipment in which a resilient bag containing fluid under pressure is disposed in a position subject to loads and a reservoir of elastomeric material which is expandable from an initial position with a minimum volume to a loaded position with an increased volume which is positioned in spaced relation to said position subject to loads. The resilient bag and reservoir are connected in fluid communication so that loads imposed on the bag force fluid from the bag to the reservoir where the energy is dissipated. After the load is removed from the resilient bag, the reservoir returns to its original shape to return the fluid to the resilient bag. The protective equipment incorporating the load absorbing apparatus can be in the form of a helmet with a relatively rigid shell or a body protected pad having a flexible outer cover.

10. U.S. Pat. No. 5,551,082, invented by Stewart et al., entitled "Protective Athletic Pants Having Diagonal Protect Pads Around Hip, Buttocks And Thigh Areas"

The patent to Stewart et al. An athletic garment designed to protect the wearer from injury during athletic activity such as in-line roller skating, skiing, volleyball, mountain biking, basketball, hockey, field hockey, ice skating or gymnastics. The invention uses strategically placed and rib-shaped gel, air or elastic foam padding to protect the wearer from the impact and abrasion of a fall caused by such activity.

The prior art patents noted above largely entail features such as: chest protectors with multiple sections of foam padding, in a grid-like configuration; chest protectors with extra rigid panels specially placed to protect the heart; chest protectors with pouches for insertion of additional pads; and other protective equipment utilizing gel, such as padded clothing and athletic supporters.

In contrast, the present invention is a chest protector that utilizes a soft, pliable gel to enhance absorption and dissipation of impact forces. The gel is durable and lightweight, and is configured in separate panels to keep the same from flowing across the chest protector. This provides added protection when the user is struck in the chest area with potentially damaging items. As an additional benefit, the gel may be frozen or refrigerated to help cool the player in hot weather.

SUMMARY OF THE INVENTION

As noted, the present invention is an enhanced chest protector for usage in sporting events and hazardous activities. More particularly, the invention is a chest protector that utilizes a soft, pliable gel attached to the previously-existing chest protector to greatly enhance absorption and dissipation of impact forces.

The gel is of a type commonly used for heat or freezer packs, and is configured in many separate panels to keep the gel from flowing across the entire device. Importantly, the gel is durable and lightweight, which allows the player to wear the product comfortably for extended periods of time. In addition, the gel may be frozen or refrigerated prior to use, so as to provide cooling for the player in hot weather. In total, usage of the present invention allows the user to be well-protected when struck in the chest area with potentially damaging items, such as balls or pucks used in sporting events.

In light of the foregoing, it is generally an object of the present invention to provide a device that gives greater protection that chest protectors of the prior art.

It is a further object of the invention to provide a device that also serves to cool the player during sporting activities in hot weather.

It is a further object of the invention to provide a device that is relatively lightweight and comfortable for the user to wear.

It is a further object of the present invention to provide a device that is relatively inexpensive to manufacture, produce, and distribute.

It is a further object of the present invention to provide a device that may be manufactured in a variety of shapes and sizes.

In addition, it is an object of the present invention to provide a device that is suitable for usage in a variety of activities, including baseball, lacrosse, hockey, and other sports.

It is an object of the present invention to provide a device that may include text or graphics thereon, for the purposes of advertisement.

It is also an object of the present invention to provide a device that may bear at least one of a variety of colors or designs, to match the appearance of uniforms worn therewith.

Finally, it is an object of the present invention to provide alternate embodiments of the device, wherein the invention is constructed of different materials, according to manufacturer and user needs.

The novel features which are considered characteristic for the invention are set forth in the claims. The invention itself, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
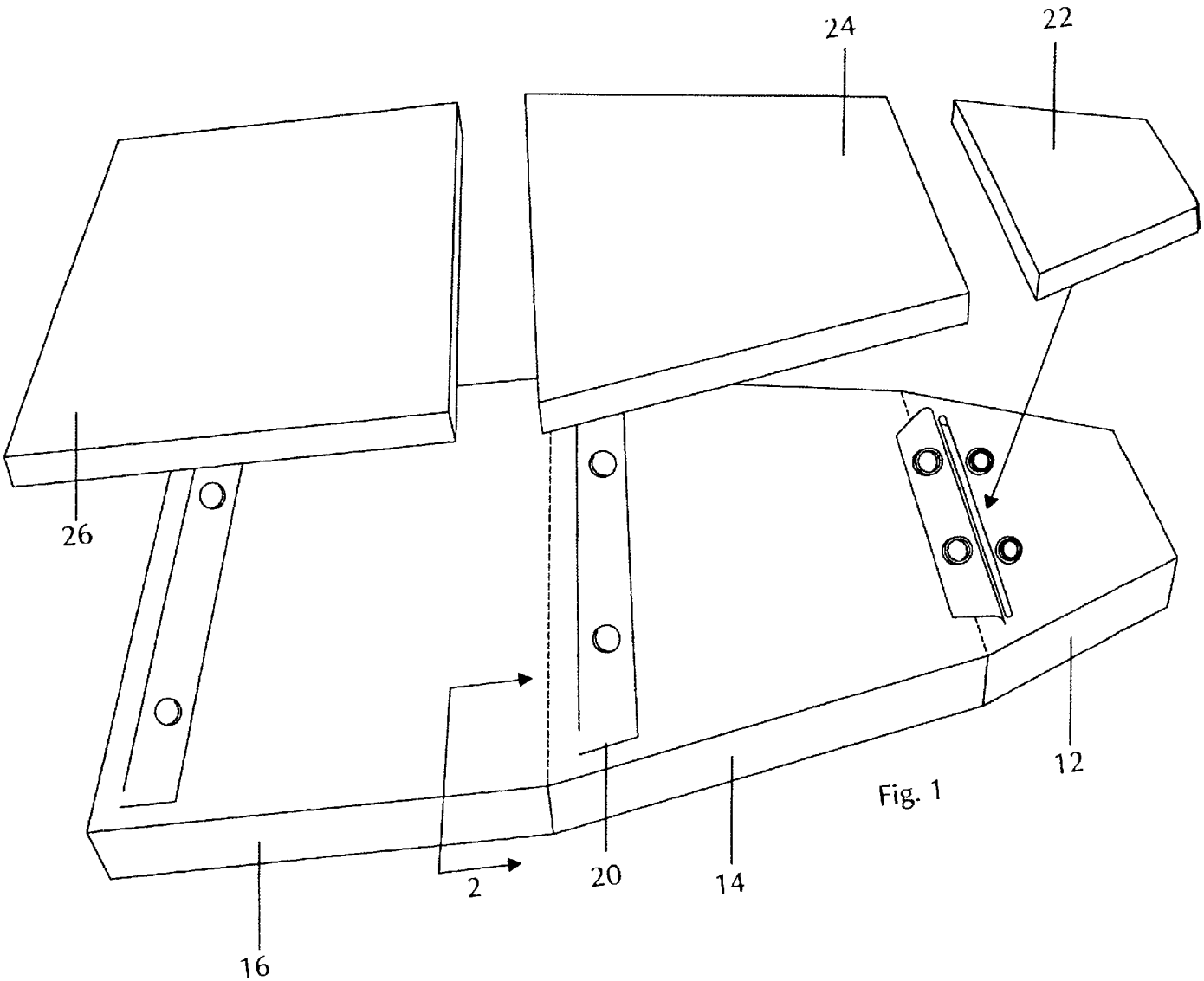
FIG. 1 is a schematic representation of the present invention, in a front, three-quarter perspective view, to illustrate the principal components thereof.
Figure 2:
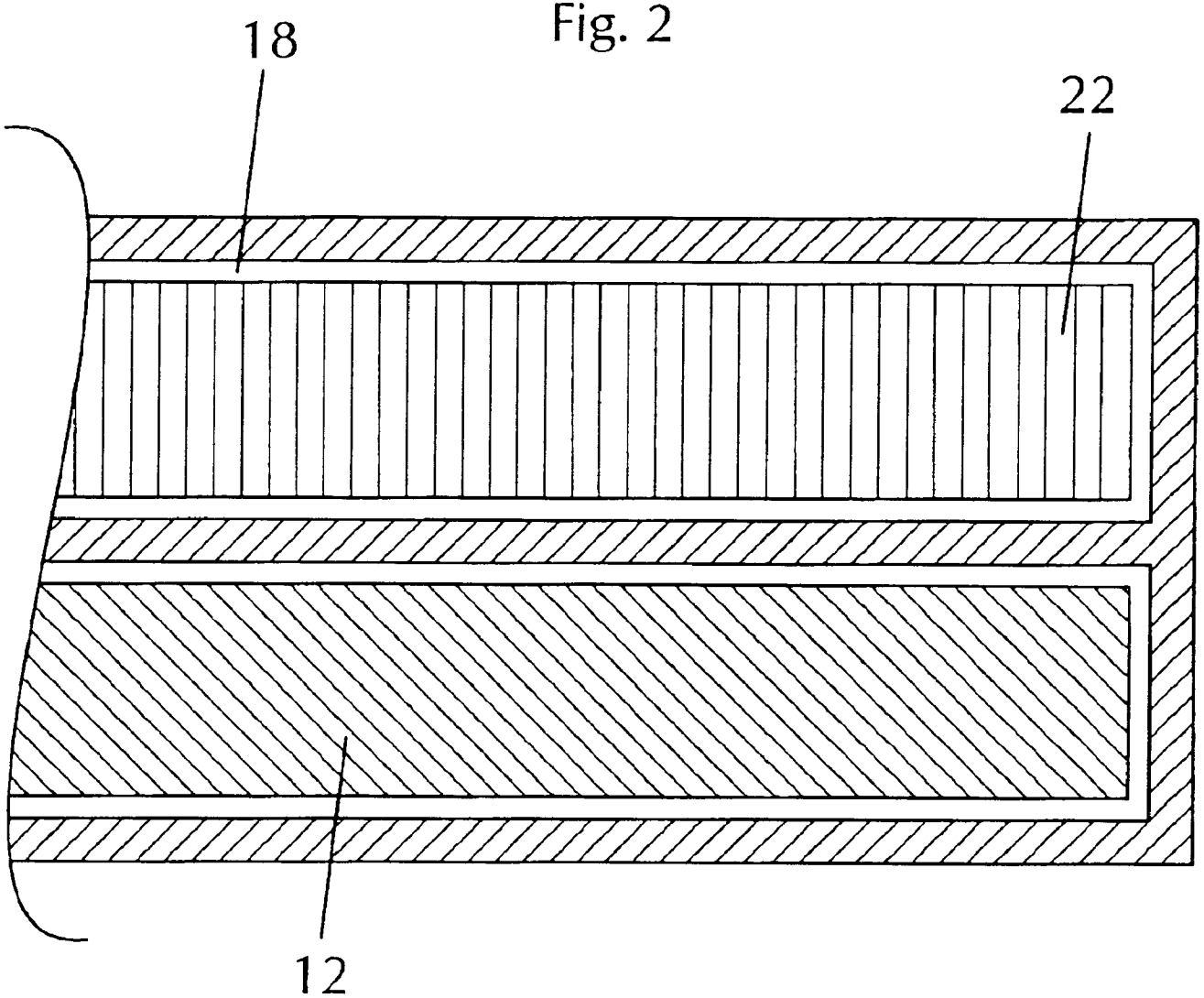
FIG. 2 is a cross sectional view along Line 2 of FIG. 1, illustrating the layers utilized in the preferred mode of the present invention.

The following description relates to FIG. 1, which is a schematic representation of the present invention, in a front, three-quarter perspective view, to illustrate the principal components thereof, and FIG. 2, which is a cross sectional view along Line 2 of FIG. 1, illustrating the layers utilized in the preferred mode of the present invention.

The enhanced chest protector for usage in sporting events and hazardous activities generally comprises a plurality of flexible pads (12, 14, 16) to absorb and dissipate impact forces, much in the manner of traditional chest protectors, such as those used by catchers in baseball.

Importantly, the enhancement of the invention comprises a pocket assembly comprising at least one pocket (18) having an interior and sealable opening (20). At least one pocket (18) is located on an area of the chest protector directly over the heart and sternum area of a user when in use, in order to provide extra protection to the most critical area of the body. Additional pockets may cover other areas of the body, including pockets lining the entire chest protector, if desired.

At least one soft, pliable gel pack (generally represented by 22, 24, 26) is removably inserted into the interior of each pocket (18). The soft, pliable gel pack functions to enhance absorption and dissipation of impact forces. This allows the user to be well-protected when struck in the chest area with potentially damaging items. Examples of such items include baseballs, hockey pucks, and lacrosse balls.

Furthermore, the soft, pliable gel pack is durable and lightweight in nature, functioning to allow the user to wear the chest protector comfortably for extended periods of time, such as in a long sporting event such as baseball.

The invention utilizes a gel commonly used in heat packs and freezer packs, which is cost-effective for manufacture and easy for the player to use.

It is important to note that the gel pack pockets are configured as multiple separate panels to keep the gel from flowing from one panel to another. This insures proper protection in all key areas of the user's torso, as modular aspect of the chest protector keeps all of the gel from flowing to one side or corner.

Another key aspect of the present invention is that the gel pack may be refrigerated or frozen prior to usage to provide cooling for users in hot weather. Such provides an important added benefit to the user, particularly for outdoor summer sports, such as baseball. As such, the ability to provide cooling will encourage more players to utilize the chest protector of the present invention, which will result in the players enjoying greater absorption and dissipation of impact forces than with traditional chest protectors.

Moreover, in enhanced embodiments of the present invention, the device bears indicia, text, and graphics thereon. For the purposes of example, the device may bear colors that match the uniform of a player, and may even include team names or logos thereon.

In addition, in all instances, the device is manufactured of a material selected from the group consisting of vinyl, plastic, and polymers. Such are relatively inexpensive and lightweight, accomplishing the purposes of the invention.

It is also important to note that the device may be manufactured in a variety of sizes. Such is particularly important so that children, who are at higher risk of injury, can enjoy the benefits of the present invention.

In addition, the soft, pliable gel pack may be manufactured in a variety of thicknesses, which allows the manufacturer to tailor the chest protector of the present invention to previously-determined sporting activities depending on the level of protection required.

In one mode of production, the enhanced chest protector is extended to cover and protect a stomach and abdominal area of the user. This provides additional protection and allows the device to be used in more sporting activities.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. An enhanced chest protector for usage in sporting events and hazardous activities comprising a plurality of flexible pads to absorb and dissipate impact forces, wherein the enhancement comprises:

a pocket assembly comprising at least one pocket having an interior and sealable opening, with at least one pocket located on an area of the chest protector directly over the heart and sternum area of a user when in use, at least one soft, pliable gel pack removably inserted into the interior of the pocket to enhance absorption and dissipation of impact forces, allowing the user to be well-protected when struck in the chest area with potentially damaging items, wherein the soft, pliable gel pack is durable and lightweight, functioning to allow the user to wear the chest protector comfortably for extended periods of time.

2. The enhanced chest protector as described in claim 1, wherein the gel pack utilizes a gel that can be used in heat packs and freezer packs.

3. The enhanced chest protector as described in claim 1, wherein the gel pack is configured in multiple separate panels to keep gel from flowing from one panel to another.

4. The enhanced chest protector as described in claim 1, wherein the gel pack is lightweight in nature.

5. The enhanced chest protector as described in claim 1, wherein the gel pack is refrigerated prior to usage to provide cooling for users in hot weather.

6. The enhanced chest protector as described in claim 1, wherein the chest protector bears indicia, text, and graphics thereon.

7. The enhanced chest protector as described in claim 1, wherein the chest protector is manufactured of a material selected from the group consisting of vinyl, plastic, and polymers.

8. The enhanced chest protector as described in claim 1, wherein the chest protector is manufactured in a variety of sizes.

9. The enhanced chest protector as described in claim 1, wherein the soft, pliable gel pack is manufactured in a variety of thicknesses.

10. The enhanced chest protector as described in claim 1, wherein the enhanced chest protector is extended to cover and protect a stomach and abdominal area of the user.

11. A method of using a chest protector as described in claim 1, comprising the steps of a user cooling a soft, pliable gel pack through refrigeration means, the user removably inserting the at least one soft, pliable gel pack into an interior of at least one pocket of a pocket assembly;

the user wearing the pocket assembly and enhanced chest protector, to provide enhanced absorption and dissipation of impact forces as well as cooling during hot temperature conditions.

* * * * *